United States Patent [19]

Schladitz

[11] 3,934,117

[45] Jan. 20, 1976

[54] ELECTRIC FLUID HEATING DEVICE

[76] Inventor: Hermann J. Schladitz, Plantschweg 74, Munich, Germany

[22] Filed: Mar. 21, 1974

[21] Appl. No.: 453,497

[30] Foreign Application Priority Data

Mar. 27, 1973 Germany ..... 2315268

[52] U.S. Cl. ..... 219/382; 219/300; 219/307; 219/368; 219/374; 338/54; 338/205

[51] Int. Cl.[2] ..... H05B 3/10; F24H 1/10

[58] Field of Search ..... 219/296–309, 219/280–283, 368, 374–376, 381, 382, 307, 300; 338/204, 205, 223–225, 54, 55

[56] References Cited

UNITED STATES PATENTS

| | | | |
|---|---|---|---|
| 679,973 | 8/1901 | Lance et al. | 219/381 UX |
| 1,151,586 | 8/1915 | Herkenrath | 219/381 UX |
| 1,396,389 | 11/1921 | Whitaker | 219/381 UX |
| 3,008,302 | 11/1961 | Rabin | 219/381 UX |
| 3,165,826 | 1/1965 | Bentov | 219/381 UX |
| 3,262,190 | 7/1966 | Rostoker | 219/381 UX |
| 3,519,255 | 7/1970 | Cooper | 219/301 UX |
| 3,688,083 | 8/1972 | Rice et al. | 219/381 |
| 3,826,895 | 7/1974 | Schladitz | 219/307 X |
| 3,833,791 | 9/1974 | Schladitz | 219/307 X |

FOREIGN PATENTS OR APPLICATIONS

| | | | |
|---|---|---|---|
| 531,112 | 12/1940 | United Kingdom | 219/381 |
| 1,096,375 | 12/1967 | United Kingdom | 219/381 |

*Primary Examiner*—A. Bartis
*Attorney, Agent, or Firm*—Kane, Dalsimer, Kane, Sullivan and Kurucz

[57] ABSTRACT

An electric heating device for heating fluid media includes a plurality of disc-shaped porous bodies each consisting of a plurality of felted togehter polycrystaline metal whiskers grown out of a gas phase and connected each to one another at their points of contact. A plurality of disc-shaped electric heating elements alternate with the bodies to form a column for connection to a voltage source. The total electrical resistance of the elements is greater than the total electrical resistance of the porous bodies. In one embodiment the bodies and elements are both porous and form a longitudinal passage along the column and means are provided for delivering fluid medium to one end of the passage to be heated as it flows lengthwise of the column. In another arrangement the bodies and elements are centrally apertured to form a central longitudinal passage and means are provided for delivering the fluid medium to one end of the passage. In this arrangement the heating elements may be non-porous whereby the fluid medium flows radially through the porous bodies for heating. Alternatively, the heating elements may also be porous in which case fluid medium is heated as it flows radially through the elements as well as through the elements bodies.

3 Claims, 5 Drawing Figures

ELECTRIC FLUID HEATING DEVICE

BACKGROUND OF THE INVENTION

The invention relates to electric heating devices. It is particularly concerned with the rapid heating of fluid media using at least one porous member. This may consist of a plurality of polycrystalline metal whiskers grown out of the gas phase, felted together and connected at their points of contact. The member is heated electrically and the medium which is to be heated is passed through it.

An electric heating device of this type is described, inter alia, in German Pat. No. 1,288,705.

Porous members which consist of inter-connected polycrystalline metal whiskers can be produced with an extremely large inner surface area for their overall volume. This is possible because the polycrystalline metal bodies have a well above average strength for their diameter (of the order of a few microns to less than 1 micron) and can therefore be worked into skeletal structures capable of standing up to fluid or gas pressures at which skeletons of other materials would be torn apart or excessively compressed. Manufacture and properties of such polycrystalline metal whiskers are described, inter alia, in German Pat. No. 1,224,934 and in the "Zeitschrift fur Metallkunde" Vol. 59 (1968, No. 1, pages 18–22.

Such porous members are used with great success as resistance heating elements for the vaporizing or atomization of liquid fuels (see *Ingenieur Digest* 1972, No. 12, pages 43 to 44). A certain difficulty arises, however, from the ready electrical conductivity, i.e. the low electrical resistance of such a whisker skeleton, which gives rise to heavy currents. The use of compensating resistances for the purpose of reducing the current strength is not justifiable on economic grounds, and the use of a transformer for the purpose of lowering the voltage is in many cases impossible or not desirable. Furthermore, the electrical resistance of such whisker skeletons can be varied only within relatively narrow limits.

SUMMARY OF THE INVENTION

The invention is based on the problem of providing an electric heating device of the type mentioned above, the current absorption of which can be varied at will and adapted to given circumstances without the aid of expensive or uneconomical accessory equipment.

According to one aspect of the present invention there is provided an electric heating device for heating fluid media, comprising at least one porous body consisting of a plurality of felted-together polycrystalline metal whiskers grown out of the gas phase and connected to one another at their points of contact, means for guiding the medium to be heated through the body, and an element with which the body is in heat-conductive communication, said element being adapted to be heated by the passage of an electric current therethrough and having an electrical resistance greater than that of the porous body.

With such a device the porous body is not or at least not exclusively heated directly by an electric current. Instead, it is heated indirectly by a structural element which is in turn heated by electric current. The electrical resistance of this element can be adapted to the available current source and the heat energy required.

In one preferred embodiment the element which is heated by electrical current is a conductor wound around a tube of readily heat-conductive material in which the porous body is disposed in heat-conductive communication with the tube wall. When current passes along the electric conductor the heat generated heats the porous body indirectly through the tube wall.

In another embodiment the element which is heated by electric current consists of a tube of electrically conductive material in which the porous body is disposed and with whose wall it is in heat-conducting communication, the tube wall being electrically insulated from said body over the greater part of its length. The tube and the porous body are electrically connected in series. The total resistance of this electric heating device is the sum of the individual resistances of the tube and of the porous body, and since the electrical resistance of the tube is a multiple of the electrical resistance of the porous body, the porous body is only negligibly heated directly by electric current. Its main heating is effected by the absorption of heat from the more intensely heated tube.

The electric heating device can also be built-up into a column from alternately superimposed disc-shaped porous bodies and disc-shaped electric heating elements which are in heatconductive connection with one another, the total electrical resistance of the heating elements being a multiple of the total electrical resistance of the porous bodies. The electric heating elements are connected electrically in series, possibly via the interposed porous bodies. With this construction also the porous bodies are mainly heated by the absorption of heat from the electric heating elements. In order to achieve a rapid heat absorption these discs should be relatively thin, for example only a few millimeters or fractions of millimeters thick; and the diameter will generally be a multiple of their thickness.

The electric heating elements may be formed by a woven fabric or felt, constituted by metallized carbon threads for example. A principal object of such metallization is to set the total resistance of the electric heating device at a definite value. This metallization may be effected after the column has been assembled, the column being connected to a current source and the electric heating elements consisting of carbon threads being heated by direct passage of current. The temperature is raised to the decomposition temperature of a thermally decomposable metal compound, preferably a metal carbonyl, after which the metal compound is passed in vapor form through the column, decomposing and depositing metal on the carbon threads. The heating and the passage of the metal compound through the column is continued until such time as the desired total electrical resistance of the column is achieved. This can be monitored constantly by means of an ohm meter.

Alternatively, the electric heating elements may be constituted by plates or screens made from a heat conductive alloy or felts made from organic or inorganic fibers or polycrystalline metal whiskers which are provided with a coating of collodal graphite.

The disc-shaped porous bodies and the disc-shaped electric heating elements may be disposed serially and alternately in the direction of flow of the medium which is to be heated, so that one heating element is disposed between each adjacent pair of porous bodies. To enable the heating elements to be traversed by the medium to be heated they must be permeable to the medium.

Particularly for the heating of gasification of hydrocarbons, it is advantageous for the heating device to be traversed radially from inwards outwardly, since with such a through-flow, an ever larger pore volume is available to the medium which is to be heated. This is in line with the increase in volume of the hydrocarbon which becomes converted to vapor as it passes through the heating device. In this way the danger of clogging or localized overheating of the heating device is largely avoided. For this purpose the column may consist alternately of disc-shaped porous bodies and disc-shaped electric heating elements, each being centrally apertured to form a central longitudinal duct which communicates with a supply line for the medium to be heated. The column is enclosed at a distance by a casing which accommodates the heated medium emerging radially from the column. The disc-shaped electric heating elements are preferably substantially pore-free; in other words they have closed lateral faces in order to be able to offer the adjacent disc-shaped porous bodies a large heat transfer area. Such pore-free electric heating elements may for example, be a felt or fabric of possibly metallized carbon threads whose pores are filled with a suitable medium, for example, a heat-resistant cement.

BRIEF DESCRIPTION OF THE DRAWING

For a better understanding of the invention some constructional forms will now be described by way of example, with reference to the accompanying drawing in which.

DESCRIPTION OF THE PREFERRED EMBODIMENT

In each example to be described at least one porous body is provided and consists of a plurality of felted-together polycrystalline metal whiskers. Preferably they are connected metallically to one another at their points of contact and are grown out of the gas phase. The porous body is traversed by the medium which is to be heated. The heating of the porous body is mainly effected indirectly by means of electrical energy, the porous body being in heat-conductive communication with an element which is heated by the passage of electric current through it. The electrical resistance of this element will be several times that of the porous body.

Figure 1:
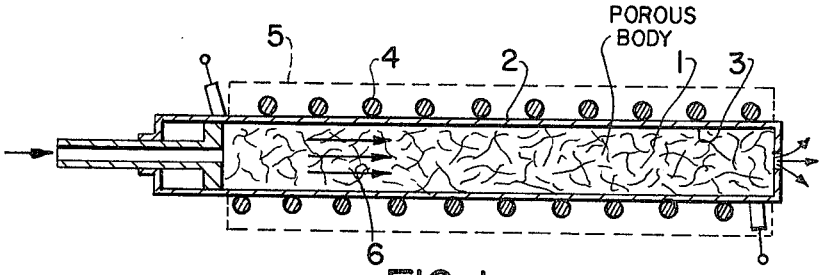
FIG. 1 is a longitudinal sectional view of a first embodiment of a heating device in accordance with the invention.

In FIG. 1, the porous body 1 is disposed inside a tube 2 made from readily heat-conductive material and is in heat-conductive contact with the tube wall 3. The tube 2 may be formed for example, by a layer of insulating lacquer applied to the surface of the porous body 1.

The tube 2 has wound around it an electric heating conductor 4, the ends of which are connected to the poles of a current source. The entire heating device is enclosed by an insulating cover 5 indicated in outline. The porous body 1 is traversed by the liquid or gaseous medium which is to be heated flowing in the direction of the arrows 6. The medium is heated solely by heat radiation or conduction from the heating conductor 4. Since the porous body 1 consists of polycrystalline metal whiskers which at their points of contact are connected to one another metallically, preferably by decomposition of metals from the gaseous phase, it has a very high heat conductivity. Thus the heat given off by the electric heating conductor 4 is very rapidly and evenly dispersed throughout the entire porous body 1.

Figure 2:
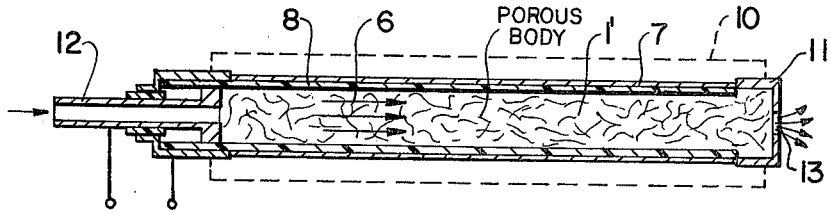
FIG. 2 is a longitudinal sectional view of a second embodiment of a heating device in accordance with the invention.

In FIG. 2 a thin-gauge tube 7 made from a heat and electrically conductive alloy encases the porous body 1′, which is in heat conductive contact with the inner wall of the tube but is electrically insulated therefrom. The electrical insulation is achieved by a layer 8 of an insulating lacquer. The tube 7 is in turn enclosed by a heat insulating cover 10 shown in outline.

In this example the tube 7 and the porous body 1′ are electrically connected in series. The right-hand ends (as seen in the Figure) of the porous body 1 and the tube 7 are connected to each other in an electrically-conductive manner by a metal cap 11. The left-hand end of the porous body 1 is provided with a fluid inlet duct 12 which is connected to one pole of a current source. The other pole of this current source is connected to the left-hand end of the tube 7, which is electrically insulated from the duct 12 as well as from the porous body 1 over most of its length. The medium to be heated is supplied via the duct 12, traverses the porous body 1′ in the direction of the arrows 6 and possibly in vapor form emerges through a central aperture 13 in the cap 11.

As mentioned above, the electrical resistance of the tube 7 is a multiple of the electrical resistance of the porous body 1′. Consequently the porous body 1′ is substantially less heated by direct passage of current than the tube 7 and so the desired heating of the porous body 1′ occurs predominantly by absorption of the heat given off by the tube 7. The proportion of the resistances of the tube 7 and of the porous body 1′ may be approximately 5 : 1. In order to increase the electrial resistance, the tube 7 may be wound from a strip, the turns of which are spaced or electrically separated from one another so that the entire length of the strip serves as a heating conductor.

Figure 3:
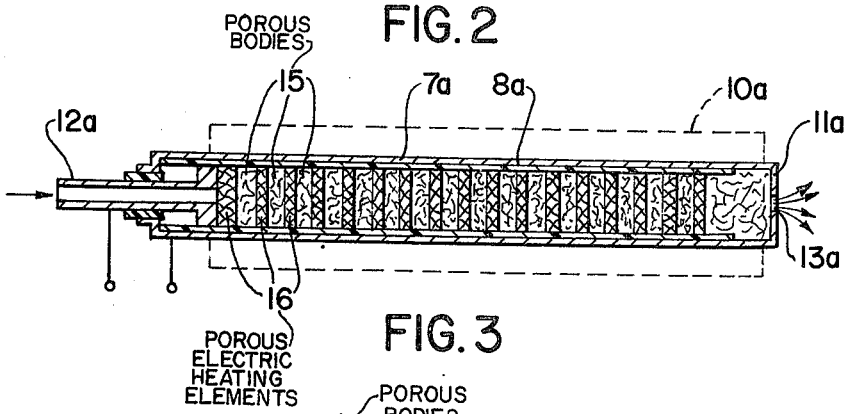
FIG. 3 is a longitudinal sectional view of a third embodiment of a heating device in accordance with the invention.

In FIG. 3 where identical or equivalent component parts are identified by the same reference numerals as in FIG. 2 but with a suffix *a*, there are alternately disposed in the electrically conductive tube 7*a* disc-shaped porous bodies 15 made from polycrystalline metal whiskers and disc-shaped electrical heating elements 16. The diameter of each disc is a multiple of the thickness, and the discs are electrically insulated from the tube 7*a* by a coating 8*a*. The disc-shaped heating elements 16 are electrically connected in series by means of the interposed porous bodies 15. The column formed from discs 15 and 16 is electrically connected in series with the tube 7*a*, in a similar manner to the body 1′ of FIG. 2. Since the disc-shaped heating elements 16 have a considerably greater electrical resistance than the disc-shaped porous bodies 15, the heating elements 16 are more intensely heated by the electric current than are the porous bodies 15, and so they give off heat to the porous bodies 15.

As in the case of the preceeding examples, the heating device is transversed in the longitudinal direction of the tube *7a* by the medium which is to be heated. This requires that the disc-shaped electric heating elements 16 should also be permeable to the medium which is to be heated. These heating elements 15 may consist, for example, of carbon threads, either in the form of a felt or in the form of a gauze. The individual heating elements 16 may consist of several layers of gauze. Alternatively, the heating elements 16 may consist of screens or perforated plates of a heat conductive alloy, or a felt made from organic or inorganic fibers or polycrystalline metal whiskers which have a graphite coating consisting of colloidal graphite.

In this embodiment, the total electrical resistance can be adjusted to a predetermined value by the extent to which the threads or fibers forming the heating elements 16 are coated with metal. For this purpose the complete heating device formed by the porous bodies 15, the heating elements 16 and the tube *7a* is connected to a current source so that the heating elements 16 are heated by direct electric current passing through them. The temperature is raised to that of decomposition of a thermally decomposable metal compound, preferably a metal carbonyl. Then the carbonyl in vapor form is passed through the device, the carbonyl decomposing and depositing metal onto the heating threads of the heating elements 16. This metallization also produces an attachment of the heating elements 16 to the adjacent porous bodies 15. When the desired total resistance is attained, which can be established during metallization by a connected resistance measuring device, heating of the column and the supply of carbonyl vapor are stopped.

Without metallization, the electrical resistance of the heating elements 16 may be approximately a hundred times as great as the porous bodies 15.

Figure 4:
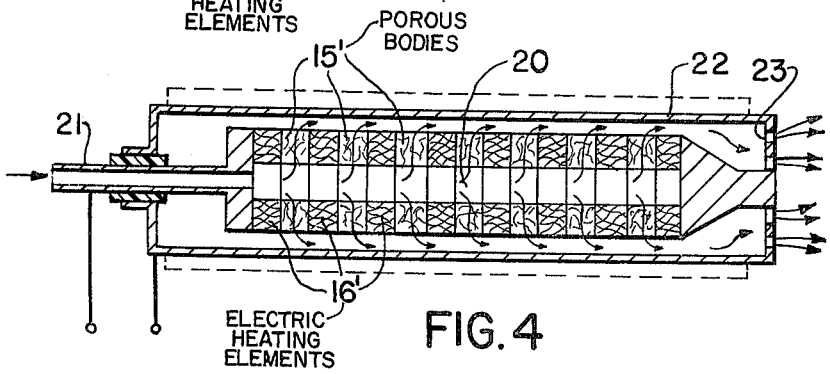
FIG. 4 is a longitudinal sectional view of a fourth embodiment of a heating device in accordance with the invention.

Similarly to the example of FIG. 3, the device of FIG. 4 is provided with a column built up from small discs, disc-shaped porous bodies 15' of polycrystalline metal threads alternating the disc-shaped electric heating elements 16'. However, the discs are centrally apertured to create an axial passage 20. The heating elements 16' are electrically connected in series by means of the interposed porous bodies 15, while the outermost pair of heating elements 16' are electrically associated respectively with a duct 21 for the supply of the medium to be heated and with a metal casing 22 which encloses the column of discs, leaving an annular space. The column is connected to the poles of a current source via the duct 21 and casing 22.

In FIG. 4 the medium to be heated is directed along the axial passage 20, whence it escapes in a radially outward direction. The electric heating elements 16' can, but do not have to be porous since the medium to heated can be passed solely through the porous bodies 15'. As with the preceeding example, the electric heating elements 16' may consist of a woven fabric or a felt, possibly composed of metallized carbon threads. The pores may, however, be filled with a cement.

Figure 5:
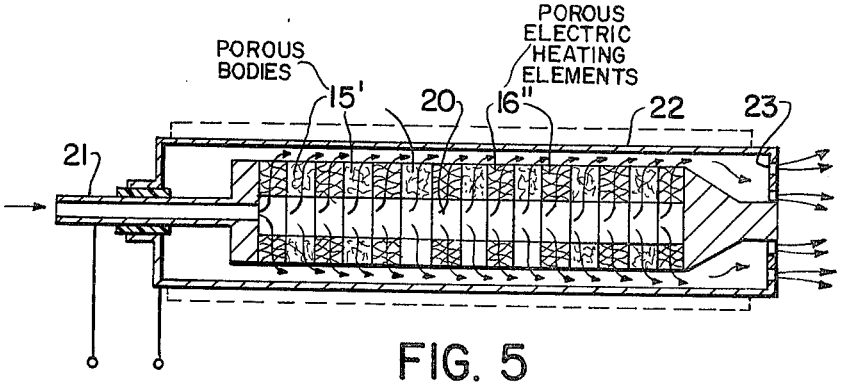
FIG. 5 is a longitudinal sectional view of a fifth embodiment of a heating device in accordance with the invention.

FIG. 5 depicts the heating elements 16'' as being porous with the remaining component parts which are identical to components of FIG. 4 bearing the same reference numerals.

The heated medium which emerges possibly in vapor form radially from the porous bodies 15' collects in the casing 22 and is drawn or forced out through the apertures 23, at the right hand end.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. An electric heating device for heating fluid media, comprising; disc-shaped porous bodies consisting of a plurality of felted together polycrystalline metal whiskers grown out of the gas phase and connected to one another at their points of contact, disc-shaped electric heating elements alternating with said bodies to form a column for connection to an electric voltage applying means, said disc-shaped bodies and elements being centrally apertured to form a central longitudinal passage along the column, means for delivering the medium to be heated to said passage, and a casing enclosing the column to form a surrounding space, the passage communicating with said space through at least the disc-shaped porous bodies, said space having an outlet for the heated medium, the total electrical resistance of said elements being greater than the total electrical resistance of said porous bodies.

2. A device according to claim 1, wherein the disc-shaped electric heating elements are substantially pore-free.

3. An electric heating device for heating fluid media, comprising; disc-shaped porous bodies consisting of a plurality of felted together polycrystalline metal whiskers grown out of the gas phase and connected to one another at their points of contact, disc-shaped electric heating elements alternating with said bodies to form a column for connection to an electric voltage applying means, said disc-shaped bodies and elements being porous to form a longitudinal passage along the the column, means for delivering the medium to be heated to said passage for passage through said bodies and elements, the total electrical resistance of said elements being greater than the total electrical resistance of said porous bodies.

* * * * *